US006502664B1

(12) United States Patent
Peaker, Sr.

(10) Patent No.: US 6,502,664 B1
(45) Date of Patent: Jan. 7, 2003

(54) ACCESSORIZED STEPLADDER

(76) Inventor: Donald Peaker, Sr., 42 E. Bel Air Ave. Apt 11, Aberdeen, MD (US) 21001

( * ) Notice: Subject to any disclaimer, the term of this patent is extended or adjusted under 35 U.S.C. 154(b) by 0 days.

(21) Appl. No.: 10/028,103

(22) Filed: Dec. 21, 2001

(51) Int. Cl.[7] ..... E04G 1/00; A47G 29/02
(52) U.S. Cl. ..... 182/129; 182/230; 248/238
(58) Field of Search ..... 182/129, 107, 182/214, 230; 206/372, 373; 248/210, 238, 235

(56) References Cited

U.S. PATENT DOCUMENTS

| | | | | | |
|---|---|---|---|---|---|
| 3,285,557 | A | | 11/1966 | Reda | |
| 4,261,435 | A | | 4/1981 | Winter | |
| 4,460,063 | A | | 7/1984 | Casada | |
| 4,613,042 | A | * | 9/1986 | Aeschliman | 206/372 X |
| 4,714,162 | A | * | 12/1987 | Harrisson | 182/129 |
| D340,773 | S | | 10/1993 | Bartnicki et al. | |
| 5,419,409 | A | * | 5/1995 | Corulla | 182/129 |
| 5,542,535 | A | * | 8/1996 | Dalton | 182/129 X |
| 5,544,718 | A | * | 8/1996 | Schumacher | 182/129 |
| 5,584,357 | A | * | 12/1996 | Gugel et al. | 248/238 |
| D388,882 | S | | 1/1998 | Kain | |
| 5,722,507 | A | * | 3/1998 | Kain | 182/129 |
| 5,740,883 | A | * | 4/1998 | Trank | 182/129 |
| 5,782,314 | A | | 7/1998 | Zeitler | |
| 5,899,296 | A | * | 5/1999 | Lantz | 182/107 X |
| 5,913,380 | A | * | 6/1999 | Gugel et al. | 182/129 |
| 5,934,468 | A | * | 8/1999 | Scott | 182/129 |
| 6,158,551 | A | * | 12/2000 | Gray | 182/107 |

* cited by examiner

*Primary Examiner*—Daniel P. Stodola
*Assistant Examiner*—Hugh B. Thompson

(57) ABSTRACT

An accessorized stepladder for providing increased functionality to a user. The accessorized stepladder includes a standard stepladder having a an upper platform for holding a plurality of tools and accessories, side storage members for holding fluorescent light bulbs, and an electrical box for plugging power tools into.

9 Claims, 3 Drawing Sheets

ACCESSORIZED STEPLADDER

BACKGROUND OF THE INVENTION

1. Field of the Invention

The present invention relates to ladders and more particularly pertains to a new accessorized stepladder for providing increased functionality to a user.

2. Description of the Prior Art

The use of ladders is known in the prior art. More specifically, ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 388,882; U.S. Pat. No. 4,261,435; U.S. Pat. No. 4,460,063; U.S. Pat. No. Des. 340,773; U.S. Pat. No. 5,782,314; and U.S. Pat. No. 3,285,557.

While these devices fulfill their respective, particular objectives and requirements, the aforementioned patents do not disclose a new accessorized stepladder. The inventive device includes a standard stepladder having a an upper platform for holding a plurality of tools and accessories, side storage members for holding fluorescent light bulbs, and an electrical box for plugging power tools into.

In these respects, the accessorized stepladder according to the present invention substantially departs from the conventional concepts and designs of the prior art, and in so doing provides an apparatus primarily developed for the purpose of providing increased functionality to a user.

SUMMARY OF THE INVENTION

In view of the foregoing disadvantages inherent in the known types of ladders now present in the prior art, the present invention provides a new accessorized stepladder construction wherein the same can be utilized for providing increased functionality to a user.

The general purpose of the present invention, which will be described subsequently in greater detail, is to provide a new accessorized stepladder apparatus and method which has many of the advantages of the ladders mentioned heretofore and many novel features that result in a new accessorized stepladder which is not anticipated, rendered obvious, suggested, or even implied by any of the prior art ladders, either alone or in any combination thereof.

To attain this, the present invention generally comprises a standard stepladder having a an upper platform for holding a plurality of tools and accessories, side storage members for holding fluorescent light bulbs, and an electrical box for plugging power tools into.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new accessorized stepladder apparatus and method which has many of the advantages of the ladders mentioned heretofore and many novel features that result in a new accessorized stepladder which is not anticipated, rendered obvious, suggested, or even implied by any of the prior art ladders, either alone or in any combination thereof.

It is another object of the present invention to provide a new accessorized stepladder which may be easily and efficiently manufactured and marketed.

It is a further object of the present invention to provide a new accessorized stepladder which is of a durable and reliable construction.

An even further object of the present invention is to provide a new accessorized stepladder which is susceptible of a low cost of manufacture with regard to both materials and labor, and which accordingly is then susceptible of low prices of sale to the consuming public, thereby making such accessorized stepladder economically available to the buying public.

Still yet another object of the present invention is to provide a new accessorized stepladder which provides in the apparatuses and methods of the prior art some of the advantages thereof, while simultaneously overcoming some of the disadvantages normally associated therewith.

Still another object of the present invention is to provide a new accessorized stepladder for providing increased functionality to a user.

Yet another object of the present invention is to provide a new accessorized stepladder which includes a standard stepladder having a an upper platform for holding a plurality of tools and accessories, side storage members for holding fluorescent light bulbs, and an electrical box for plugging power tools into.

Still yet another object of the present invention is to provide a new accessorized stepladder that utilizes a specially designed upper platform for holding a bucket and a plurality of tools, paperwork, and other accessories normally required when working on a ladder.

Even still another object of the present invention is to provide a new accessorized stepladder that includes storage tubes for holding fluorescent light bulbs during changing, and an electrical box to eliminate the typical pull of an extension cord on power tools or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
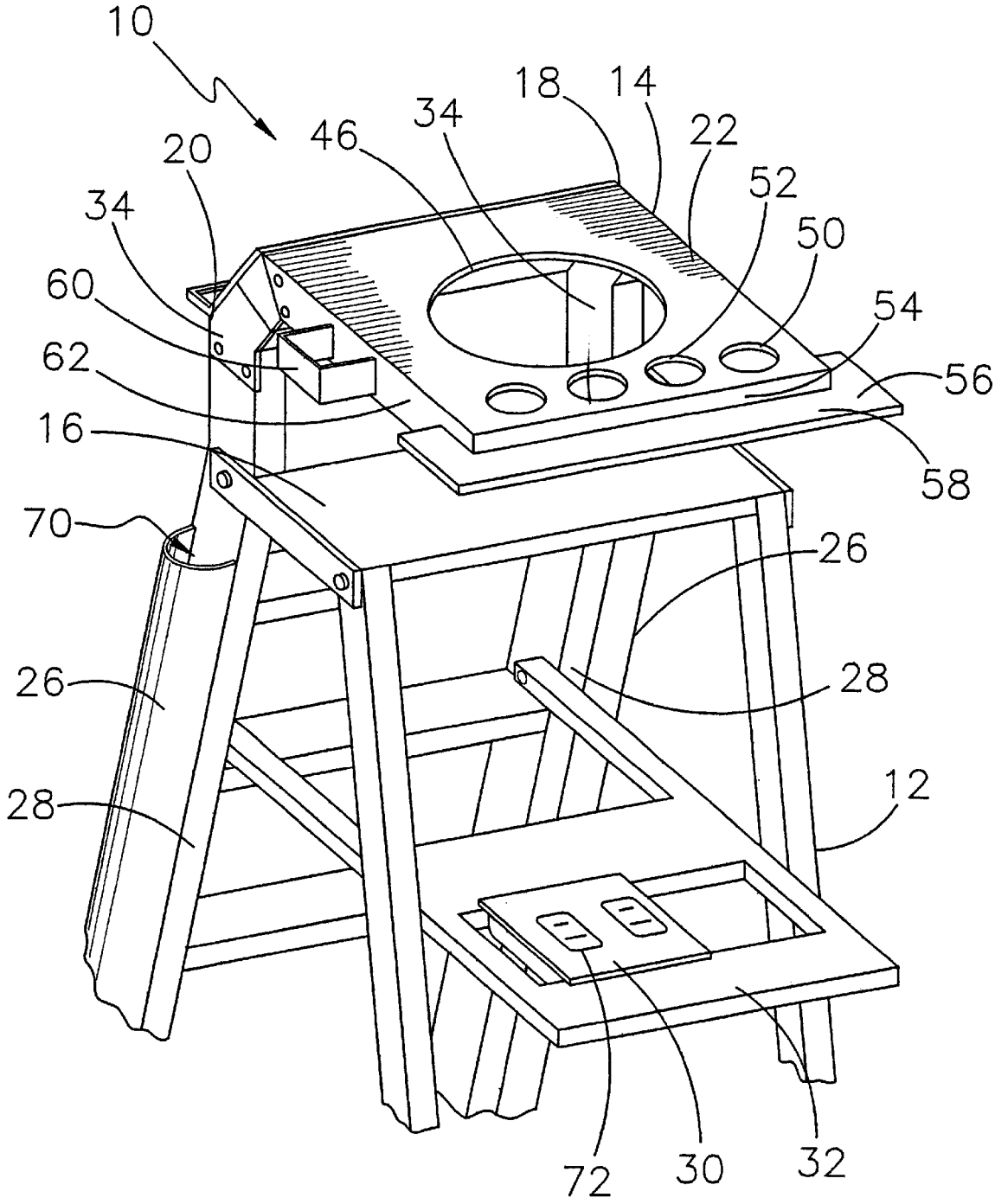
FIG. 1 is a perspective view of the upper section of a new accessorized stepladder according to the present invention.
Figure 2:
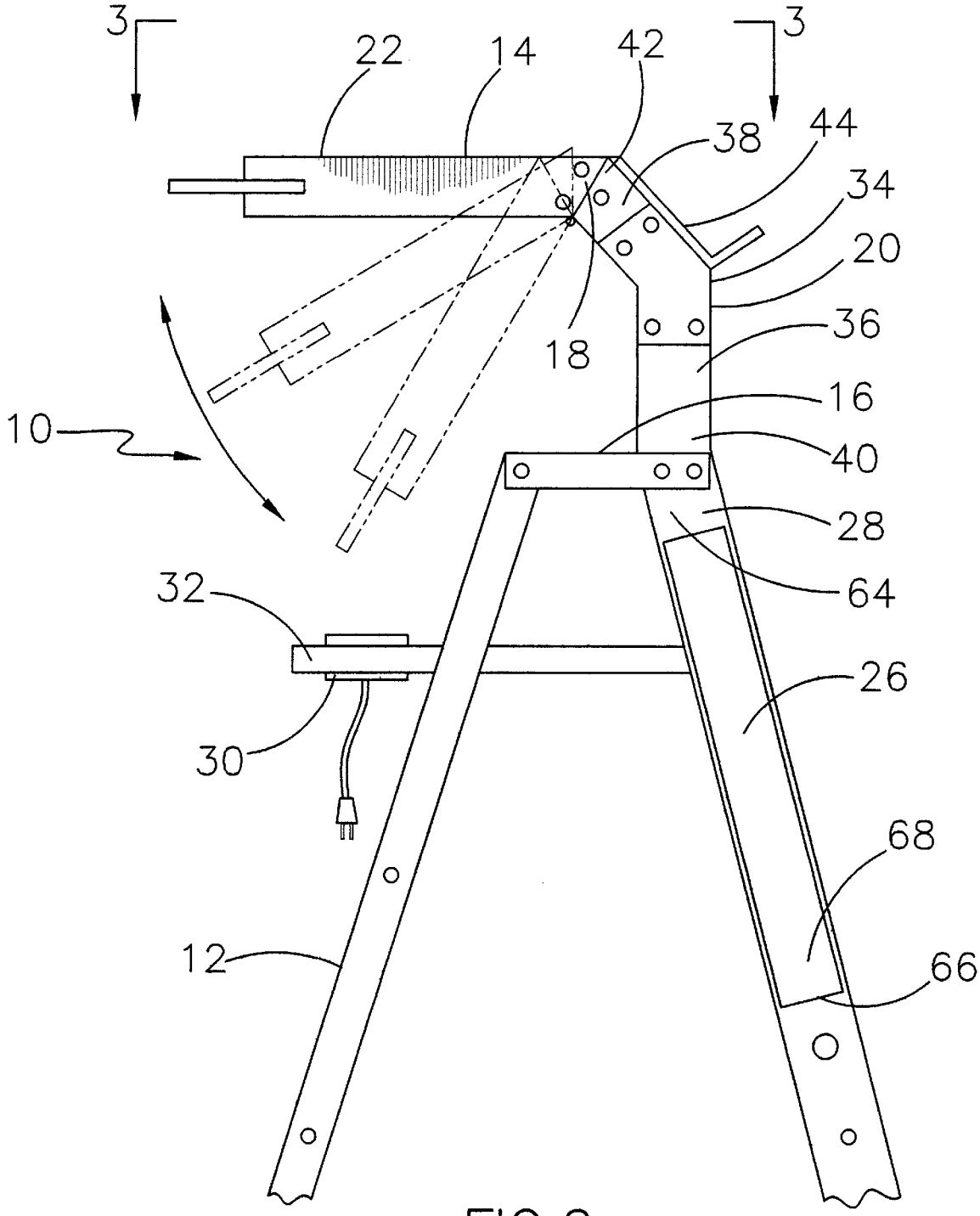
FIG. 2 is a side view of the present invention.
Figure 3:
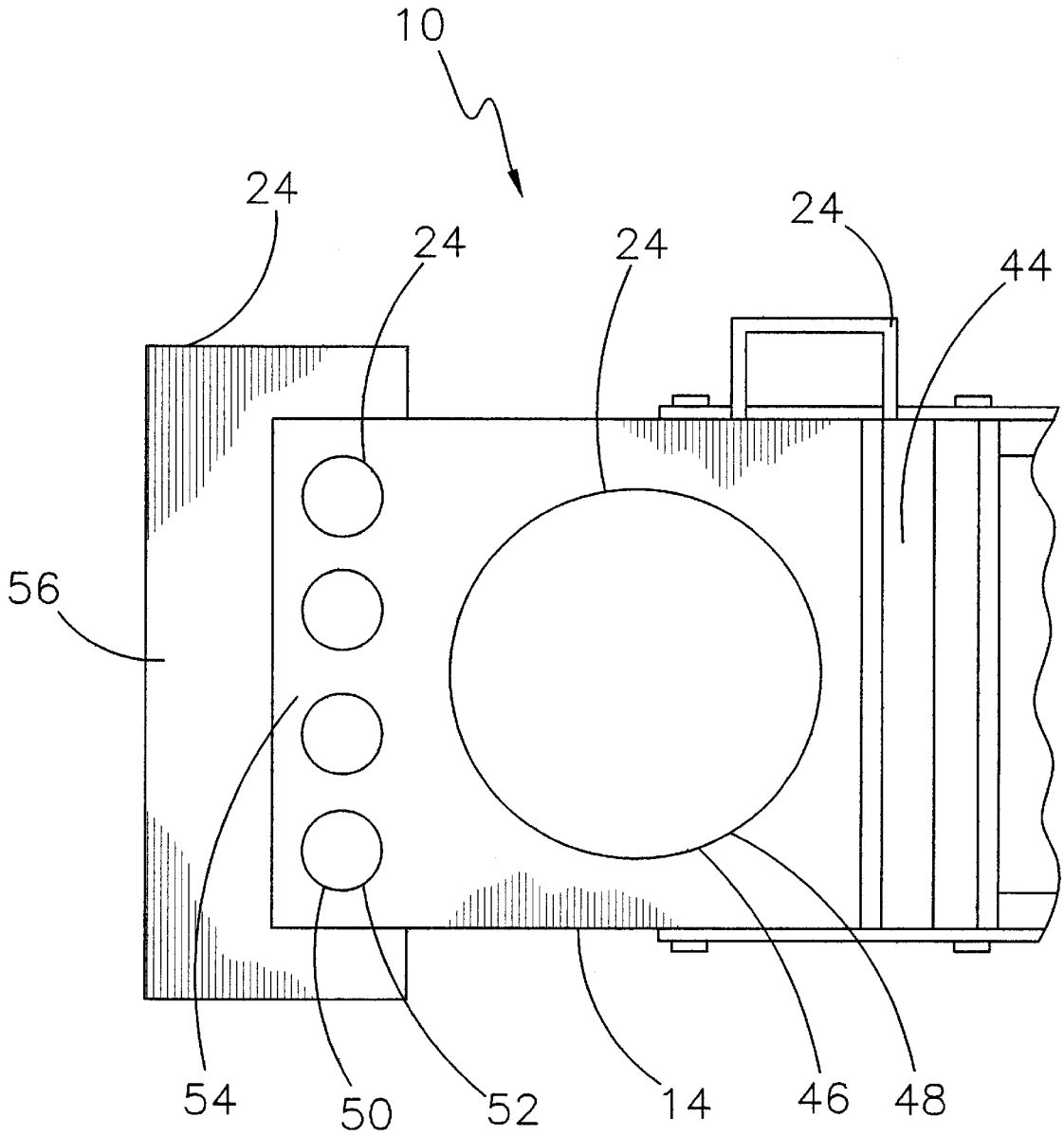
FIG. 3 is a top view of the upper section of the present invention.

With reference now to the drawings, and in particular to FIGS. 1 through 3 thereof, a new accessorized stepladder embodying the principles and concepts of the present invention and generally designated by the reference numeral 10 will be described.

As best illustrated in FIGS. 1 through 3, the accessorized stepladder 10 generally comprises a stepladder assembly 12. The stepladder assembly 12 is of a standard design. The stepladder assembly 12 has an upper platform assembly 14. The upper platform assembly 14 is positioned proximate a top section 16 of the stepladder assembly 12.

The upper platform assembly 14 comprises a frame assembly 18. The frame assembly 18 has an extension portion 20 and a platform portion 22. The portions 20, 22 have a plurality of accessory sections 24 such that the upper platform assembly 14 is designed for placement of a variety of accessories thereby allowing the user to better utilize the stepladder assembly 12 for the undertaking of various tasks.

The stepladder assembly 12 includes a plurality of holding members 26. The holding members 26 are fixedly coupled to legs 28 of the stepladder assembly 12. The holding members 26 are designed for placing elongate objects for ease of access.

The stepladder assembly 12 includes an electrical box member 30. The electrical box member 30 is couplable to a shelf portion 32 of the stepladder assembly 12. The electrical box member 30 is designed for selectively coupling electrical devices to.

The extension portion 20 of the frame assembly 18 comprises a plurality of leg members 34. Each of the leg members 34 has a vertical portion 36 and a diagonal portion 38. A lower end 40 of the vertical portion 36 is positioned proximate the top section 16 of the stepladder assembly 12. The vertical portion 36 extends upwardly and is substantially perpendicular to the top section 16 of the stepladder assembly 12.

The diagonal portion 38 of the leg members 34 is oriented at an angle substantially away from a longitudinal axis of the vertical portion 36. An upper end 42 of the diagonal portion 38 is pivotally coupled to the platform portion 22 of the frame assembly 18 thereby allowing the platform portion 22 to collapse upon folding of the stepladder assembly 12. The leg members 34 are designed for supporting the platform portion 22.

The diagonal portion 38 of the leg members 34 has a ledge member 44. The ledge member 44 has a substantially L-shaped cross-section. The ledge member 44 is fixedly coupled to the diagonal portion 38 of the leg members 34 such that the ledge member 44 is designed for positioning documents or on for the ease of viewing.

The platform portion 22 of the frame assembly 18 has a bucket holder 46. The bucket holder 46 comprises a substantially large hole 48 centrally located in the platform portion 22. The bucket holder 46 is designed for supporting a bucket thereby allowing the user to carry liquids in a secure manner with or without a lid coupled to the bucket.

The platform portion 22 of the frame assembly 18 has a plurality of front tool holders 50. The front tool holders 50 comprise a plurality of bores 52. The bores 52 are positioned proximate a front portion 54 of the platform portion 22. The bores 52 are designed for the temporary storage of a variety of tools utilized by the user.

The platform portion 22 of the frame assembly 18 has an extension plate 56. The extension plate 56 is fixedly coupled to the front portion 54 of the platform portion 22. The extension plate 56 comprises a flat elongate member 58 such that the extension plate 56 is designed for selectively coupling to legs of a paint roller pan.

The platform portion 22 of the frame assembly 18 includes a side tool holder 60. The side tool holder 60 is positioned on a side edge 62 of the platform portion 22. The side tool holder 60 is designed for supporting one of a variety of tools in which the front tool holders 50 are not suited for.

The holding members 26 of the stepladder assembly 12 are fixedly coupled to an outer surface 64 of legs 28 of the stepladder assembly 12. The holding members 26 have a substantially semicircular cross-section.

The holding members 26 have a closed end 66. The closed end 66 is located proximate a bottom end 68 of the holding members 26 thereby forming a cavity 70. The cavity 70 is designed for receiving substantially elongate members such that the holding members 26 are designed for temporarily storing items such as tubular fluorescent light bulbs.

The electrical box member 30 of the stepladder assembly 12 comprises a plurality of electrical sockets 72. The electrical sockets 72 are designed for receiving a plurality of power cords such that the electrical box member 30 is designed for powering electrical devices when the electrical box member 30 is operationally coupled to an extension cord, thus eliminating pull on the device by the extension cord.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An accessorized stepladder assembly for providing increased functionality to a user, the accessorized stepladder assembly comprising:

a stepladder having an upper platform assembly, said upper platform assembly being positioned proximate a top section of said stepladder;

said upper platform assembly comprising a frame assembly, said frame assembly having an extension portion and a platform portion, said portions having a plurality of accessory sections such that said upper platform assembly being adapted for placement of a variety of accessories thereby allowing the user to better utilize said stepladder for the undertaking of various tasks;

said stepladder including a plurality of holding members, said holding members being fixedly coupled to legs of said stepladder, said holding members being adapted for placing elongate objects for ease of access; and said stepladder including an electrical box member, said electrical box member being couplable to a shelf portion of said stepladder, said electrical box member being adapted for selectively coupling electrical devices to; and said extension portion of said frame assembly comprising a plurality of leg members, each of said leg members having a vertical portion and a diagonal portion, a lower end of said vertical portion being positioned proximate said top section of said stepladder, said vertical portion extending upwardly substantially perpendicularly to said top of said stepladder; and said diagonal portion of said leg members being oriented at an angle substantially away from a longitudinal axis of said vertical portion, an upper end of said diagonal portion being pivotally coupled to said platform portion of said frame assembly thereby allowing said platform portion to collapse upon folding of said stepladder such that said leg members being adapted for supporting said platform portion.

2. The accessorized stepladder assembly as set forth in claim 1, further comprising:

said diagonal portion of said leg members having a ledge member, said ledge member having a substantially L-shaped cross-section, said ledge member being fixedly coupled to said diagonal portion of said leg members such that said ledge member being adapted for positioning documents on for the ease of viewing.

3. The accessorized stepladder assembly as set forth in claim 1, further comprising:

said platform portion of said frame assembly having a bucket holder, said bucket holder comprising a substantially large hole, said hole being centrally located in said platform portion, said bucket holder being adapted for supporting a bucket thereby allowing the user to carry liquids in a secure manner with or without a lid coupled to the bucket.

4. The accessorized stepladder assembly as set forth in claim 1, further comprising:

said platform portion of said frame assembly having a plurality of front tool holders, said front tool holders comprising a plurality of bores, said bores being positioned proximate a front portion of said platform portion, said bores being adapted for the temporary storage of a variety of tools utilized by the user.

5. The accessorized stepladder assembly as set forth in claim 4, further comprising:

said platform portion of said frame assembly having an extension plate, said extension plate being fixedly coupled to said front portion of said platform portion, said extension plate comprising a flat elongate member such that said extension plate being adapted for selectively coupling to legs of a paint roller pan.

6. The accessorized stepladder assembly as set forth in claim 4, further comprising:

said platform portion of said frame assembly including a side tool holder, said side tool holder being positioned on a side edge of said-platform portion, said side tool holder being adapted for supporting one of a variety of tools in which said front tool holders not being suited for.

7. The accessorized stepladder assembly as set forth in claim 1, further comprising:

said electrical box member of said stepladder comprising a plurality of electrical sockets, said electrical sockets being adapted for receiving a plurality of power cords such that said electrical box member being adapted for powering electrical devices when said electrical box member being operationally coupled to an extension cord thus eliminating pull on the device by the extension cord.

8. An accessorized stepladder assembly for providing increased functionality to a user, the accessorized stepladder assembly comprising:

a stepladder having an upper platform assembly, said upper platform assembly being positioned proximate a top section of said stepladder;

said upper platform assembly comprising a frame assembly, said frame assembly having an extension portion and a platform portion, said portions having a plurality of accessory sections such that said upper platform assembly being adapted for placement of a variety of accessories thereby allowing the user to better utilize said stepladder for the undertaking of various tasks;

said stepladder including a plurality of holding members, said holding members being fixedly coupled to legs of said stepladder, said holding members being adapted for placing elongate objects for ease of access;

said stepladder including an electrical box member, said electrical box member being couplable to a shelf portion of said stepladder, said electrical box member being adapted for selectively coupling electrical devices to;

said extension portion of said frame assembly comprising a plurality of leg members, each of said leg members having a vertical portion and a diagonal portion, a lower end of said vertical portion being positioned proximate said top section of said stepladder, said vertical portion extending upwardly substantially perpendicularly to said top section of said stepladder;

said diagonal portion of said leg members being oriented at an angle substantially away from a longitudinal axis of said vertical portion, an upper end of said diagonal portion being pivotally coupled to said platform portion of said frame assembly thereby allowing said platform portion to collapse upon folding of said stepladder such that said leg members being adapted for supporting said platform portion;

said diagonal portion of said leg members having a ledge member, said ledge member having a substantially L-shaped cross-section, said ledge member being fixedly coupled to said diagonal portion of said leg members such that said ledge member being adapted for positioning documents on for the ease of viewing;

said platform portion of said frame assembly having a bucket holder, said bucket holder comprising a substantially large hole, said hole being centrally located in said platform portion, said bucket holder being adapted for supporting a bucket thereby allowing the user to carry liquids in a secure manner with or without a lid coupled to the bucket;

said platform portion of said frame assembly having a plurality of front tool holders, said front tool holders comprising a plurality of bores, said bores being positioned proximate a front portion of said platform portion, said bores being adapted for the temporary storage of a variety of tools utilized by the user;

said platform portion of said frame assembly having an extension plate, said extension plate being fixedly coupled to said front portion of said platform portion, said extension plate comprising a flat elongate member such that said extension plate being adapted for selectively coupling to legs of a paint roller pan;

said platform portion of said frame assembly including a side tool holder, said side tool holder being positioned on a side edge of said platform portion, said side tool holder being adapted for supporting one of a variety of tools in which said front tool holders not being suited for;

said holding members of said stepladder assembly being fixedly coupled to an outer surface of legs of said stepladder, said holding members having a substantially semi-circular cross-section;

said holding members having a closed end, said closed end being located proximate a bottom end of said holding members thereby forming a cavity, said cavity being adapted for receiving substantially elongate members such that said holding members being adapted for temporarily storing items including tubular fluorescent light bulbs;

said electrical box member of said stepladder comprising a plurality of electrical sockets, said electrical sockets being adapted for receiving a plurality of power cords such that said electrical box member being adapted for powering electrical devices when said electrical box member being operationally coupled to an extension cord thus eliminating pull on the device by the extension cord.

9. An accessorized stepladder assembly for providing increased functionality to a user, the accessorized stepladder assembly comprising:

a stepladder having an upper platform assembly, said upper platform assembly being positioned proximate a top section of said stepladder;

said upper platform assembly comprising a frame assembly, said frame assembly having an extension portion and a platform portion, said portions having a plurality of accessory sections such that said upper platform assembly being adapted for placement of a variety of accessories thereby allowing the user to better utilize said stepladder for the undertaking of various tasks;

said stepladder including a plurality of holding members, said holding members being fixedly coupled to legs of said stepladder, said holding members being adapted for placing elongate objects for ease of access; and said stepladder including an electrical box member, said electrical box member being couplable to a shelf portion said stepladder, said electrical box member being adapted for selectively coupling electrical devices thereto; and said holding members of said stepladder being fixedly coupled to an outer surface of said stepladder, said holding members having a substantially semi-circular cross-section; and said holding members having a closed end, said closed end being located proximate a bottom end of said holding members thereby forming a cavity, said cavity being adapted for receiving substantially elongate members such that said holding members being adapted for temporarily storing items including tubular fluorescent light bulbs.

* * * * *